US007118428B2

(12) United States Patent
Gamaggio et al.

(10) Patent No.: US 7,118,428 B2
(45) Date of Patent: Oct. 10, 2006

(54) FEMALE TERMINAL FOR THE ELECTRICALLY CONDUCTIVE CONNECTION TO A TERMINAL PIN, ESPECIALLY A FLAT-PIN TERMINAL

(75) Inventors: Uberto Gamaggio, Frankfurt am Main (DE); Matthias Pfaff, Offenbach/Main (DE); Zelimir Loncar, Zagreb (HR)

(73) Assignee: Yazaki Europe Ltd., Hertfordshire (GB)

( * ) Notice: Subject to any disclaimer, the term of this patent is extended or adjusted under 35 U.S.C. 154(b) by 0 days.

(21) Appl. No.: 11/104,500

(22) Filed: Apr. 13, 2005

(65) Prior Publication Data

US 2005/0233651 A1 Oct. 20, 2005

(30) Foreign Application Priority Data

Apr. 14, 2004 (DE) ..... 10 2004 018 492

(51) Int. Cl.
*H01R 13/187* (2006.01)

(52) U.S. Cl. ..... 439/843; 439/846

(58) Field of Classification Search ..... 439/843–846
See application file for complete search history.

(56) References Cited

U.S. PATENT DOCUMENTS

| | | | | |
|---|---|---|---|---|
| 2,471,923 | A * | 5/1949 | Batcheller | 439/845 |
| 3,120,989 | A * | 2/1964 | Solorow et al. | 439/843 |
| 4,973,271 | A * | 11/1990 | Ishizuka et al. | 439/839 |
| 5,158,485 | A | 10/1992 | Saito et al. | |
| 5,226,842 | A | 7/1993 | Endo et al. | |
| 5,271,741 | A | 12/1993 | Saito et al. | |
| 5,810,627 | A * | 9/1998 | Gierut et al. | 439/843 |
| 6,062,918 | A | 5/2000 | Myer et al. | |
| 6,293,833 | B1 * | 9/2001 | Kamath | 439/851 |
| 2004/0009714 | A1 | 1/2004 | Endo et al. | |

FOREIGN PATENT DOCUMENTS

| | | |
|---|---|---|
| DE | 41 05 293 A1 | 8/1991 |
| DE | 42 00 368 C2 | 3/1996 |
| DE | 19727478 A1 | 1/1998 |
| DE | 103 23 106 A1 | 12/2003 |
| EP | 1 122 832 A2 | 8/2001 |
| WO | WO 96/42121 A1 | 12/1996 |

* cited by examiner

*Primary Examiner*—Briggitte Hammond
*Assistant Examiner*—X. Chung-Trans

(57) ABSTRACT

Female terminal 1 for the electrically conductive connection to a terminal pin 4, especially a flat-pin terminal, comprising base element 2, which has a tubular receiving portion 5, which forms an enclosed accommodation chamber 6 with an insertion opening 11 for the terminal pin 4, which forms a contact portion for the terminal pin 4, which has a connection portion 16, serving for the electrically conductive connection to a conductor of a cable, which consists of a material with a high electrical conductivity, a separate elastic element 3, which consists of a non-corrosive spring steel, which as a whole is accommodated in the accommodation chamber 6, which has two first leg portions, having engagement portions extending away from each other and engaging attachment through holes of the base element, which has a second leg portion, bent relative to the respective first leg portion and projecting from the insertion opening 11 away further into the accommodation chamber 6 and extending towards the contact portion.

9 Claims, 8 Drawing Sheets

FEMALE TERMINAL FOR THE ELECTRICALLY CONDUCTIVE CONNECTION TO A TERMINAL PIN, ESPECIALLY A FLAT-PIN TERMINAL

BACKGROUND OF THE INVENTION

The invention relates to a female terminal for the electrically conductive connection to a terminal pin, especially a flat-pin terminal. Such female terminals are, for example, received in a plurality in a housing body and are, for example, used in connections on wire harnesses for motor vehicles.

EP 1 122 832 A2 describes a female terminal for the electrically conductive connection to a terminal pin. The female terminal comprises a base element, which has a tubular receiving portion, forming an enclosed accommodation chamber with an insertion opening for the terminal pin. It further forms in the accommodation chamber a contact portion for the terminal pin. The base element has further a connection portion, which serves for the electrically conductive connection to the conductor of a cable. The base element can be manufactured from a first material, which is adapted to its function.

The female terminal comprises further a separate elastic element, formed leaf spring-like and comprising two portions, of which the first portion forms a retaining tab, arranged outside the base element, and serves, for example, for retaining the female terminal in a connector housing.

The elastic element has a second portion, which follows the first portion bent by about 180° to this. The same is arranged within the base element, i.e. essentially in the accommodation chamber of the base element. It comprises a portion, which ex-tends, starting from the insertion opening, further into the accommodation chamber and extends towards the contact portion of the base element. Following thereto a portion, which again extends towards the wall of the tubular receiving portion, is pro-vided. The shape of this separate elastic element necessitates, that a connection to the tubular receiving portion by means of welding is made, to achieve a secure retainment.

DE 41 05 293 A1 concerns a female terminal for the electrically conductive connection to a terminal pin. The female terminal comprises a base element, which has a tubular receiving portion, which forms an enclosed accommodation chamber with an insertion opening for the terminal pin. It further has a connection portion, serving for the electrically conductive connection to a conductor of a cable. Furthermore, a separate elastic element is provided, which is provided at one end with projections, which engage in insertion holes of the side walls. The elastic element is formed leaf spring-like and extends towards the other end arc-like upwards inclined and then again with a downwards inclination and is supported with the other end on the inner wall face of the bottom wall of the receiving portion. The path is tongue-like in the plan view, so that a central bulged portion is achieved, which projects into indentations, which are arranged in the side walls of the receiving portion.

DE 42 00 368 C2 describes a female terminal, which differs from the above de-scribed female terminal, in that the leaf-like elastic element in the intermediate portion between its two ends is additionally provided with lateral projections, which en-gage in longitudinal slots in the side walls of the receiving portion of the base element.

WO 96/42121 A1 describes a female terminal for the electrically conductive connection to a flat-pin terminal. The female terminal comprises a base element, which has a tubular receiving portion, forming an enclosed accommodation chamber with an insertion opening for the terminal pin. One wall of the tubular portion forms, further-more, a contact portion for the terminal pin. Furthermore, a connection portion, serving for the electrically conductive connection to a conductor of the cable, is attached on the tubular portion.

The female terminal further comprises a separate elastic element, which is formed from a flat material and is, as a whole, accommodated in the accommodation chamber. This elastic element comprises in total four portions, which are bent relative to each other. The first end belonging to a first portion is fixed to the tubular receiving portion close to the insertion end. The fourth portion having the free end, is also arranged in the area towards the insertion opening of the tubular receiving portion and forms a portion, against which the terminal pin abuts when being inserted. Further-more, an abutment is provided, which delimits the bending of the third portion, which is arranged in the direction towards the insertion opening in front of the fourth portion, to prevent an excessive loading of the elastic element.

DE 103 23 106 A1 describes a female terminal for the electrically conductive connection to a terminal pin, especially a flat-pin terminal, which comprises a base element and an elastic element. The base element has a tubular receiving portion, forming an enclosed accommodation chamber with an insertion opening for the terminal pin. The base element has, further, a connection portion, serving for the electrically conductive connection to a conductor of a cable, i.e. for example by means of crimping. The base element is made from a material, which has an excellent resistance against corrosion. The elastic element is made from a material which has very good elastic characteristics. The elastic element is connected to the base element, forming the female terminal body, by engagement portions.

The elastic element should, in this case, be made from a ferrous material, for example from a stainless steel or a spring steel. The base element is made from an aluminum or an aluminum alloy. The elastic element is bent U-like from a flat material and forms two opposed contact points, between which the terminal pin is inserted, to achieve an electrical contact. The elastic element is received in the accommodation chamber of the receiving portion of the base element and electrically contacts the same. In this embodiment the electrically conductive contact between the terminal pin and the female terminal is produced in that area, which has the more disadvantageous electrically conductive characteristics. The terminal pin only contacts the elastic element.

SUMMARY OF THE INVENTION

The invention is based on the object to propose a female terminal, in which the conductivity between a terminal pin and the female terminal is improved and which is easy to manufacture and to assemble.

This object is solved according to the invention by a female terminal for the electrically conductive connection to a terminal pin, especially a flat-pin terminal, comprising base element, which has a tubular receiving portion, which forms an enclosed accommodation chamber with an insertion opening for the terminal pin, which forms a contact portion for the terminal pin, which has a connection portion, serving for the electrically conductive connection to a conductor of a cable, which consists of a material with a high electrical conductivity, a separate elastic element, which consists of a non-corrosive spring steel, which as a whole is accommodated in the accommodation chamber, which has two first leg portions, having engagement portions extending away from each other and engaging attachment through holes of the base element, which has a second leg portion, bent relative to the respective first leg portion and projecting from the insertion opening away further into the accommodation chamber and extending towards the contact portion.

Of advantage in this arrangement is, that the elastic element is only used to produce an intensive contact directly between the base element, connected to a cable, and the terminal pin, which is also connected to a cable or an equipment. Thus, an electrically conductive contact is directly provided between the components, which are also electrically conductively connected to the to be connected parts, for example, the cable or a connection of an equipment.

The elastic element can be designed such, that it provides durability for the contacting function by pressure. The material of the elastic element is not important for the conductivity of the female terminal in connection with the terminal pin. The terminal pin contacts directly in an electrically conductive manner the receiving portion of the base element. This means, that those components are directly in contact with each other, which are produced from a highly conductive material. A transmission via intermediate members, which reduce such a function, is omitted.

In an embodiment of the invention it is provided, that the elastic element has, following the second leg portion, a third leg portion, which is bent relative to the second leg portion such, that it extends away from the contact portion and that a transition portion of the elastic element between the second leg portion and the third leg portion forms the support base for the terminal pin. With this solution an essential improvement is achieved insofar, as the elastic element is protected against excessive over-loading. If a predetermined deflection path is achieved, the elastic element abuts with the free end of the third leg portion a wall, enclosing the accommodation chamber.

Preferably, the base element has a receiving portion tubular in cross-section and an accommodation chamber enclosed by walls arranged at a right angle to each other.

The invention provides two possibilities for forming the contact portion. A first possibility is, that a wall is provided with a portion, projecting into the accommodation chamber and forming the contact portion. Thus, an impression can be provided, so that a defined contact portion is formed.

The invention provides, furthermore, as a possibility, that at least one contact tab, punched out from one wall and bent into the accommodation chamber, forms the contact portion.

For the elastic element the invention also provides two embodiments. According to a first embodiment, the elastic element is bent from a round wire and comprises, respectively, two first leg portions, two second leg portions and two third leg portions, wherein the third leg portions are connected to each other and the engagement portions are bent from the first leg portions, extending away from each other. However, it can also be bent from a flat material.

Furthermore, basically two attachment possibilities for the elastic element in the accommodation chamber of the receiving portion of the female terminal are provided. In the first possibility the two first leg portions are provided with two bent engaging portions, extending away from each other and which engage in attachment through holes of the base element. A form-fitting retainment is, therefore, achieved. This embodiment is valid for the manufacture of the elastic element, made from a round wire. But also, when the elastic element is bent from a flat material, it has two first leg portions, having engagement portions extending away from each other and engaging in attachment through holes of the base element.

In both cases an additional retainment can be provided such, that the base element has a securing tab, which engages between the two first leg portions and, therefore, an exiting of the engagement portions out of the attachment through holes is pre-vented.

Preferably, the base element is made from a high electrically conductive material. It is, preferably, manufactured by punching out and bending from a sheet material.

BRIEF DESCRIPTION OF THE DRAWINGS

In the drawings different embodiments of the invention are schematically shown. It shows.

DETAILED DESCRIPTION OF THE INVENTION

Figure 1:
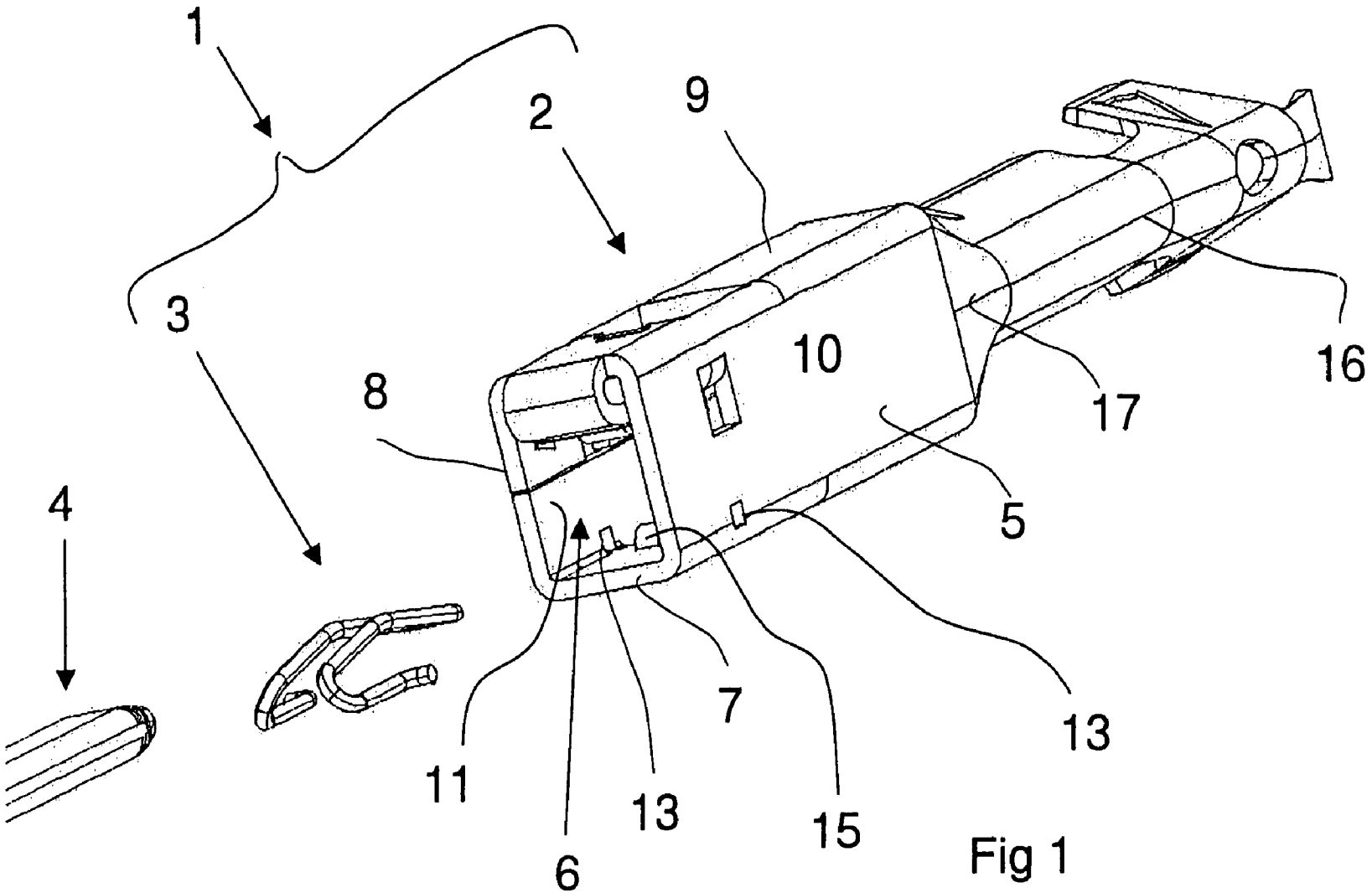
FIG. 1 is a perspective exploded view of the individual parts of a first embodiment of a female terminal with the arrangement of a terminal pin thereto.
Figure 2:
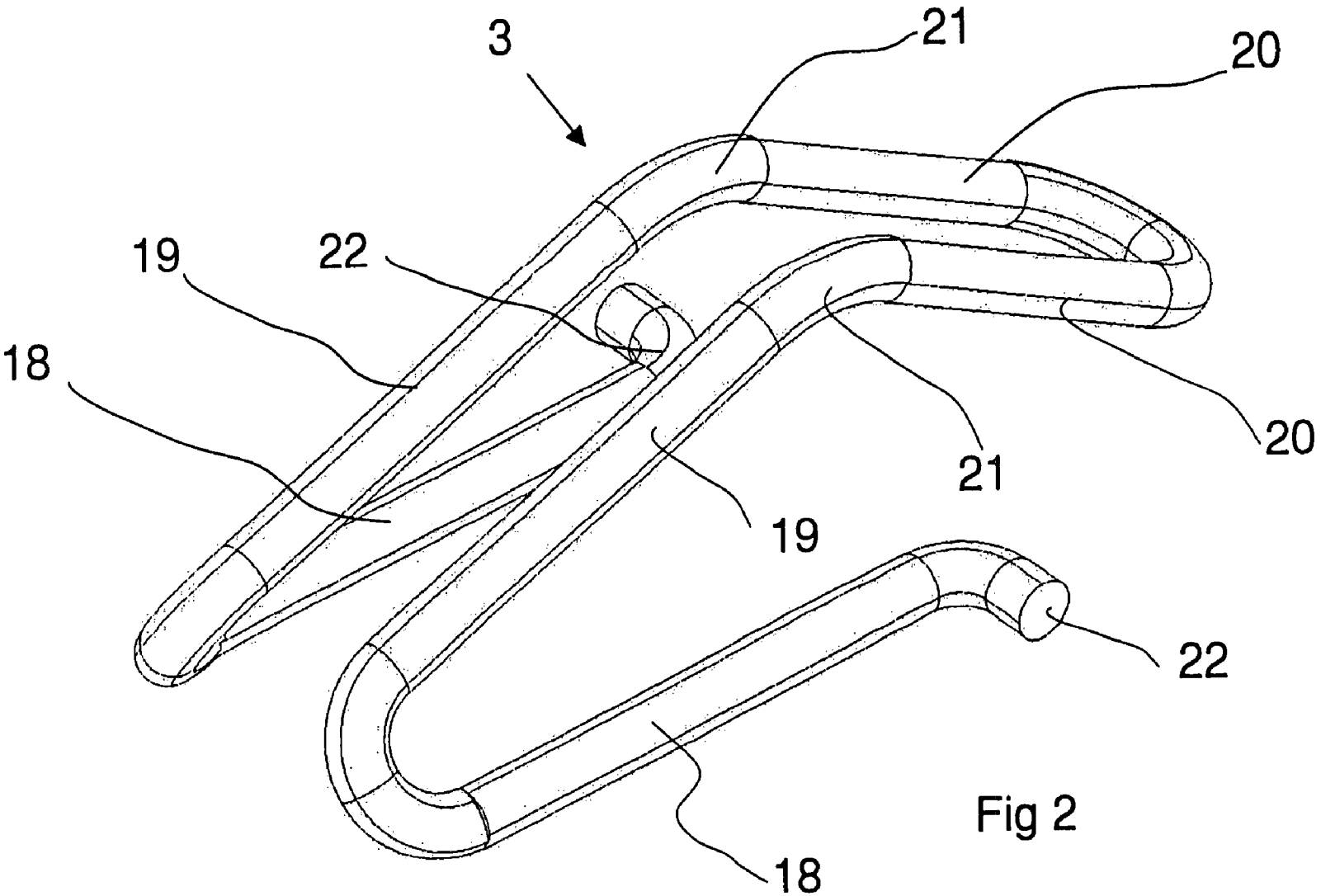
FIG. 2 is the elastic element of FIG. 1 as an individual part in an enlarged perspective representation.
Figure 3:
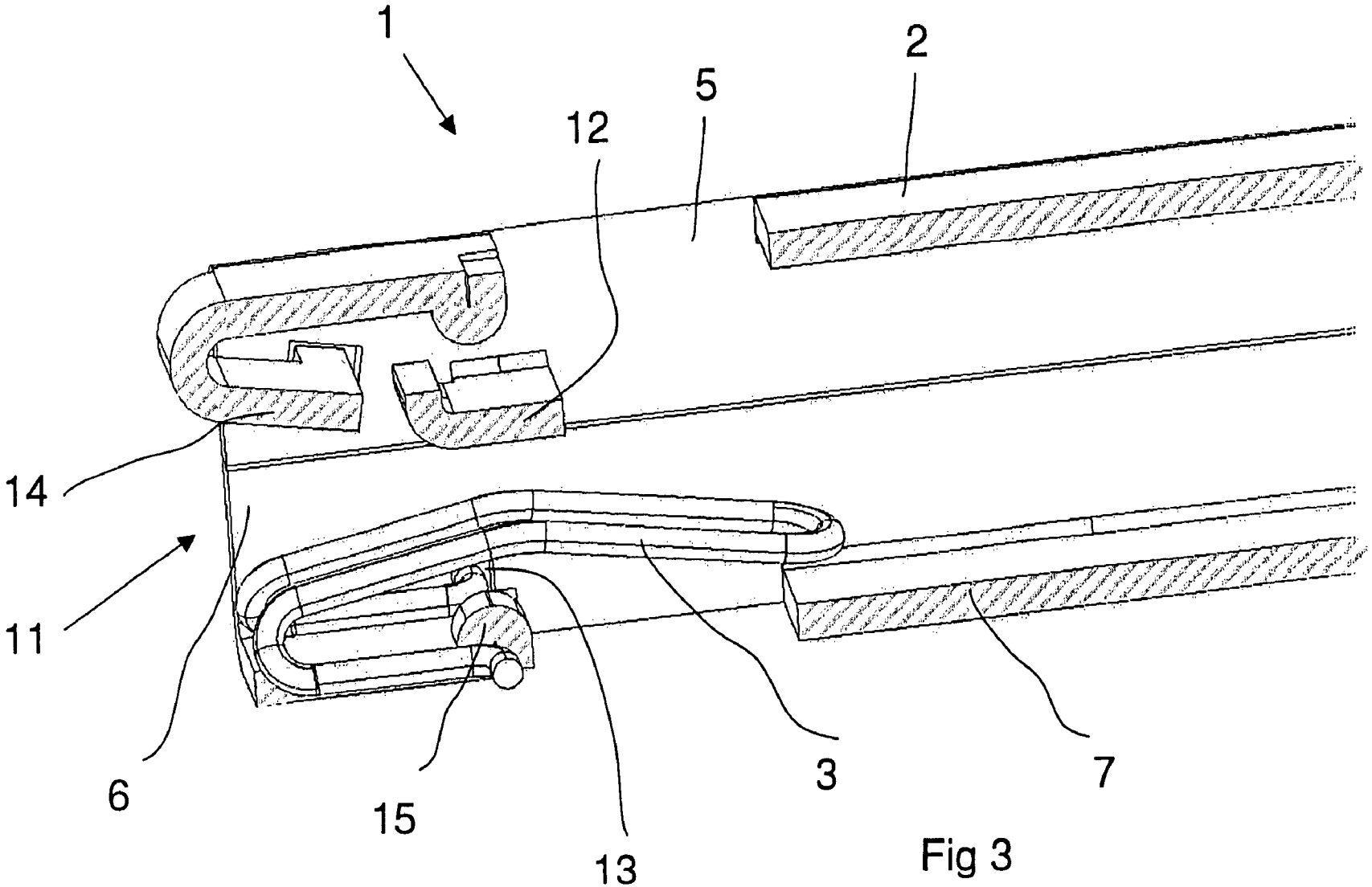
FIG. 3 is a portion of the receiving portion of the base element with the elastic element attached thereto, in a longitudinal sectional view.

Initially, a first embodiment is described by means of FIGS. 1 to 3. In FIG. 1 the base element 2 and the elastic element 3 are visible before the assembly of the two. The two, together, form the female terminal 1. Furthermore, a terminal pin 4 is shown, which can be inserted into the female terminal 1 for achieving an electrically conductive connection.

The female terminal 1 comprises a tubular receiving portion 5, enclosing an accommodation chamber 6. The receiving portion 5 is formed by means of bending a sheet-like and highly electrically conductive material and comprises a first wall 7, a second wall 8, bent thereto at a right angle, a third wall, bent again at a right angle thereto and extending essentially parallel to the first wall 7, and a fourth wall 10, extending essentially parallel to the second wall 8 and arranged at a right angle to the first wall 7. These enclose accommodation chamber 6 rectangular in cross-section, forming an insertion opening 11 for the terminal pin 4. From the two parallel walls 8, 10, namely the second wall 8 and the fourth wall 10, extending parallel thereto, a tab is, respectively, punched out and is bent such, that it projects inwards into the accommodation chamber, so that they together form a contact portion 12, which is, especially, visible concerning the tab projecting from the second wall 8. The terminal pin 4 contacts the contact portion 12 when being inserted into the accommodation chamber 6 through the insertion opening 11. In the second wall 8 and the fourth wall 19 an attachment through hole 13 is, respectively, provided with a distance to the insertion opening 11. Furthermore, in an area between the two attachment through holes 13 a securing tab 15 is punched from the first wall 7 and is bent into an area between the two attachment through holes 13, wherein to these, respectively, a clearance remains. To facilitate the insertion of the terminal pin 4 in the direction towards the contact portion 12, a portion is bent from the third wall 9 through the insertion opening 11 into the accommodation chamber 6 for forming a guide element 14.

The receiving portion 5 is followed by a transition portion 17 away from the insertion opening 11, which again is followed by a connection portion 16. The connection portion 16 comprises crimping tabs, of which one pair serves for contacting the conductor of a cable and the other pair serves for contacting the insulation of the cable. The receiving portion 5, the transition portion 17 and the connection portion 16 are formed integrally and are manufactured as punch components before bending.

The elastic element 3, shown in FIG. 1 in a non-connected manner to the base element 2, is shown in FIG. 2 as an individual component and is described by means of the same in detail in the following. The elastic element 3 is formed from a round wire made from a non-corrosive spring steel, for example a stainless steel, by bending. It comprises two first leg portions 18, arranged essentially in one plane, relative to which the following two second leg portions 19 are bent such, that they form with the first leg portions 18 approximately a V. These second leg portions 19 are, preferably, followed by a third leg portion 20, respectively, via a transition portion 21. The two third leg portions 20 are connected to each other by an arc. The two first leg portions 18, the two second leg portions 19 and the two third leg portions 20 are arranged in pairs in a separate plane. The two third leg portions 20 are again bent extending to-wards the two first leg portions 18. The free ends of the two first leg portions 18 are bent at a right angle and form opposite extending engagement portions 22.

It is also possible, to omit the two third leg portions 20 and to connect the two second leg portions 19 at their free ends.

FIG. 3 shows the assembled condition of the elastic element 3 in the accommodation chamber 6 of the receiving portion 5 of the base element 2. In this case, the two engagement portions 22 engage, respectively, in one of the attachment through holes 13 of the receiving portion 5, i.e. in the two walls 8, 10, wherein the securing tab 15 engages between the two first leg portions 18. Thus, the two engagement portions 22 are retained in the attachment through holes 13. The two first leg portions 18 are supported in the accommodation chamber 6 on the first wall 7. They extend, starting from the engagement portions, initially in the direction towards the insertion opening 11 and then away from the same deeper into the accommodation chamber 6. In this case, the transition portions 21 come to rest such, that they are arranged opposite to the contact portion 12.

The terminal pin 4 enters into the gap between the contact portion 12 and the two transition portions 21 of the elastic element 3. To prevent, that an excessive loading of the elastic element 3 occurs, the two third leg portions 20 are bent such, that they again extend away from the contact portion 12 and thus, approximate the first wall 7. If during a loading a deflection occurs, the elastic element 2 together with the portion, connecting the two third leg portions 20, contacts the first wall 7. Thus, a loading, possibly excessively loading the elastic element 3, is prevented.

Figure 4:
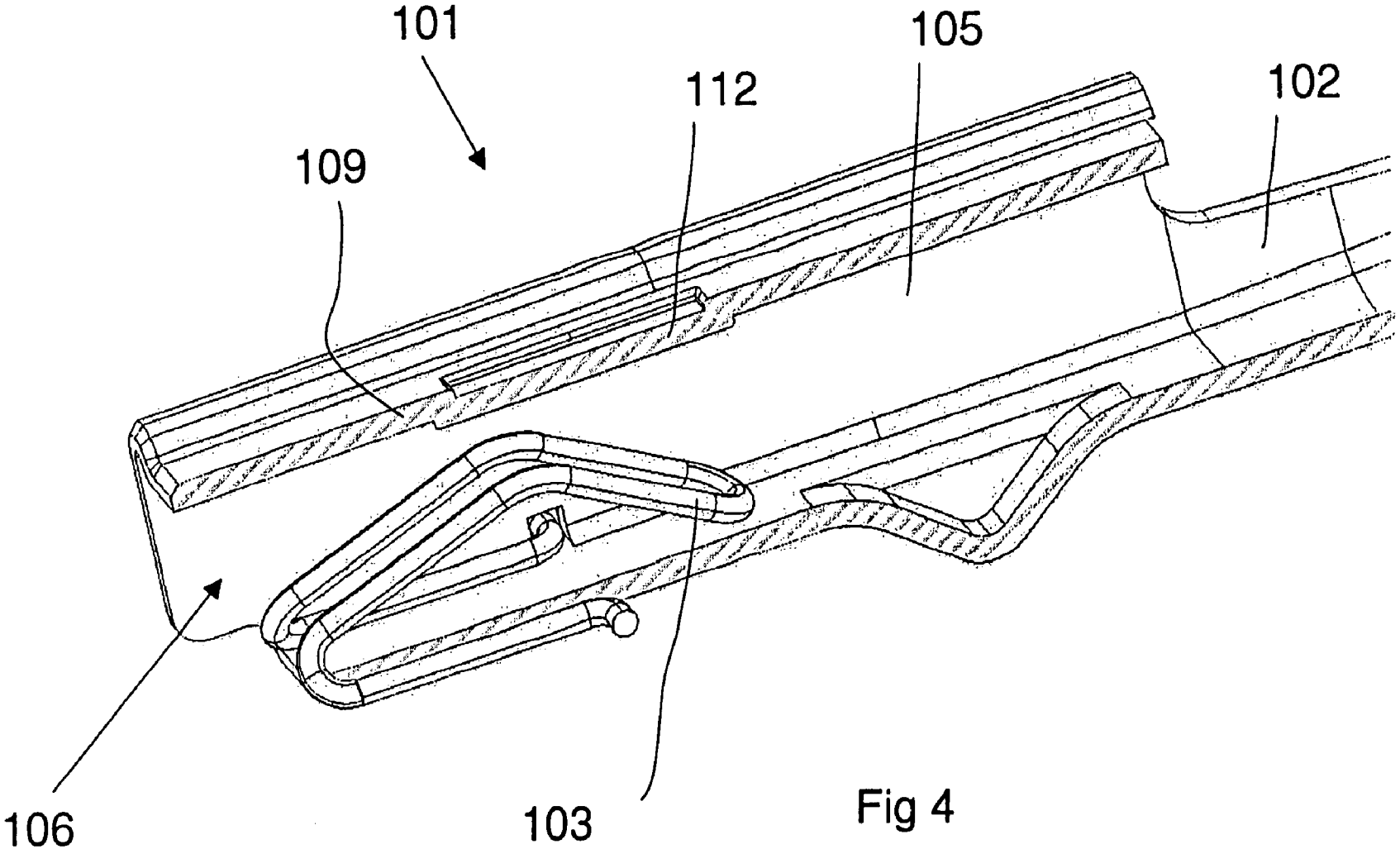
FIG. 4 is a representation in a longitudinal sectional view comparable to FIG. 3 for a female terminal with a different contact portion in the accommodation chamber of the receiving portion than that of the embodiment of FIG. 1 to 3.

FIG. 4 shows an embodiment of a female terminal 101, in which an even more compact design of the base element 102 in the area of the receiving portion 105 can be achieved, than it is possible in connection with the embodiment of FIGS. 1 to 3. The contact portion 112 is achieved in the female terminal 101 in the area of the receiving portion 105 of the base element 102 such, that the third wall 109 is provided with an impression projecting into the accommodation chamber 106. The impression forms the contact portion 112, projecting into the accommodation chamber 106 and which is opposed to the transition portions of the elastic element 103.

The elastic element 103 corresponds, in this case, in its construction completely to that of the first embodiment and the elastic element 3, shown especially as an individual component in FIG. 2. Furthermore, the elastic element 103 is also as in the embodiment of FIGS. 1 to 3 secured via engagement projections in the base element 102 by engagement in the corresponding attachment through holes. Only the insertion portion of the receiving portion 105 is formed slightly different, insofar as the elastic element 103 is set back further from the insertion opening than in the embodiment of FIGS. 1 to 3.

In the first and the second embodiment the arrangement is such, that the elastic element 3 or 103, respectively, urges the contact pin 4 directly against the contact portion 12 or 112, respectively, to produce a direct electrically conductive connection between the terminal pin 4 and the base element 2 or 102, respectively, which are also, respectively, connected to a conductor.

Figure 5:
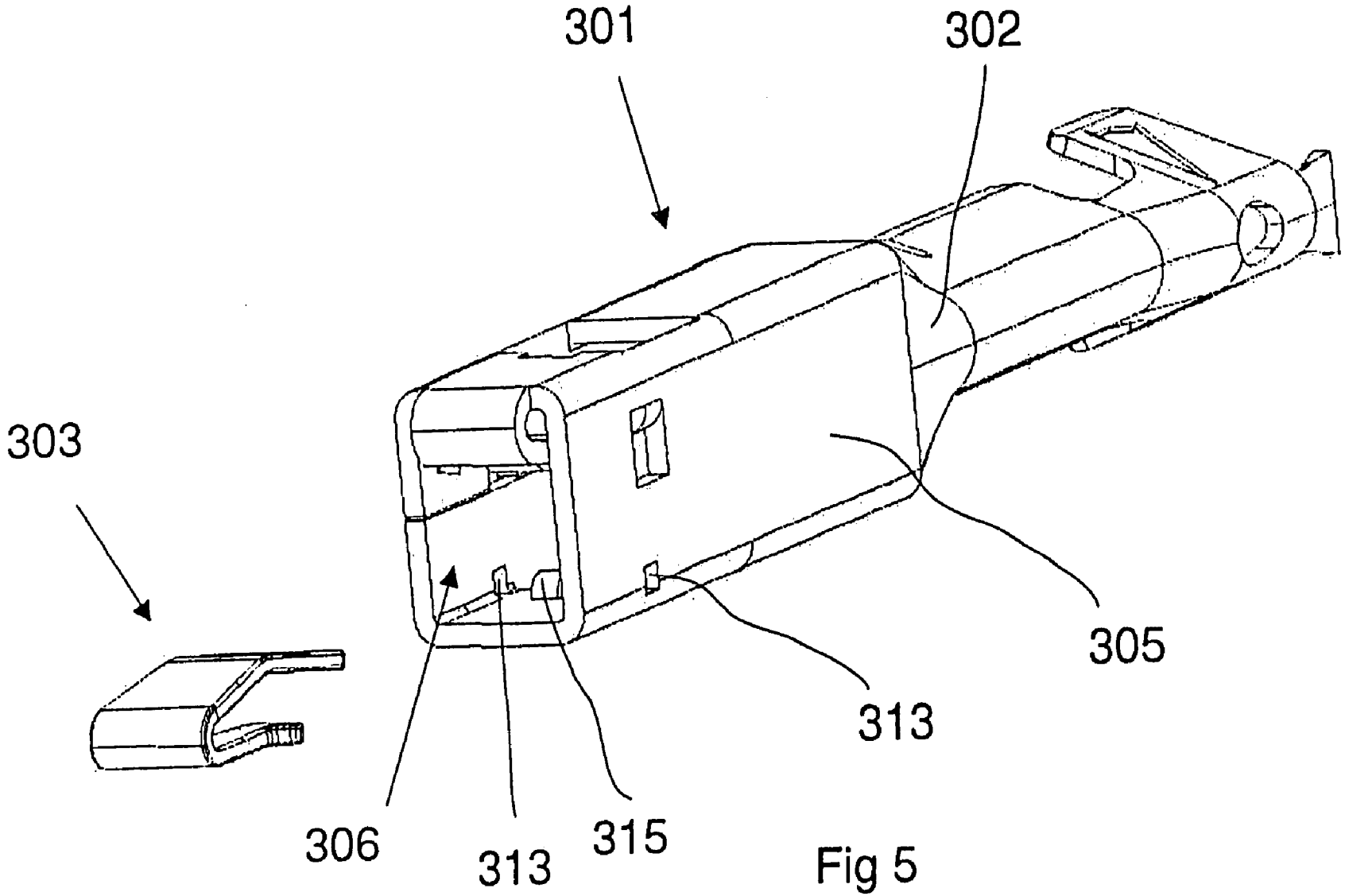
FIG. 5 is a perspective exploded view of a female terminal, which corresponds to the embodiment of FIG. 1 to 3, with the arrangement of an elastic element, made from a flat material and before its assembly.
Figure 6:
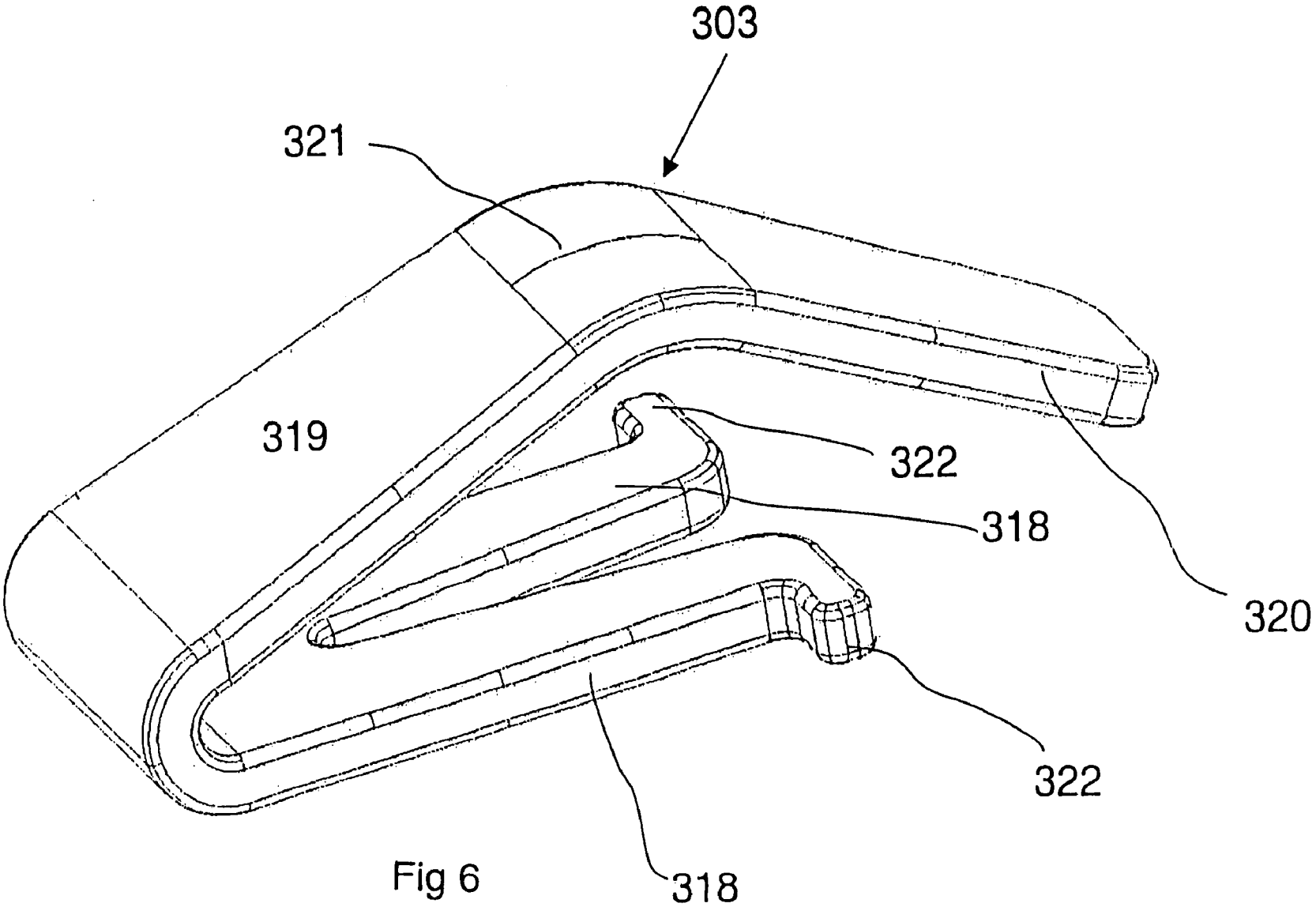
FIG. 6 is a perspective view of the elastic element of FIG. 5 as an individual part.
Figure 7:
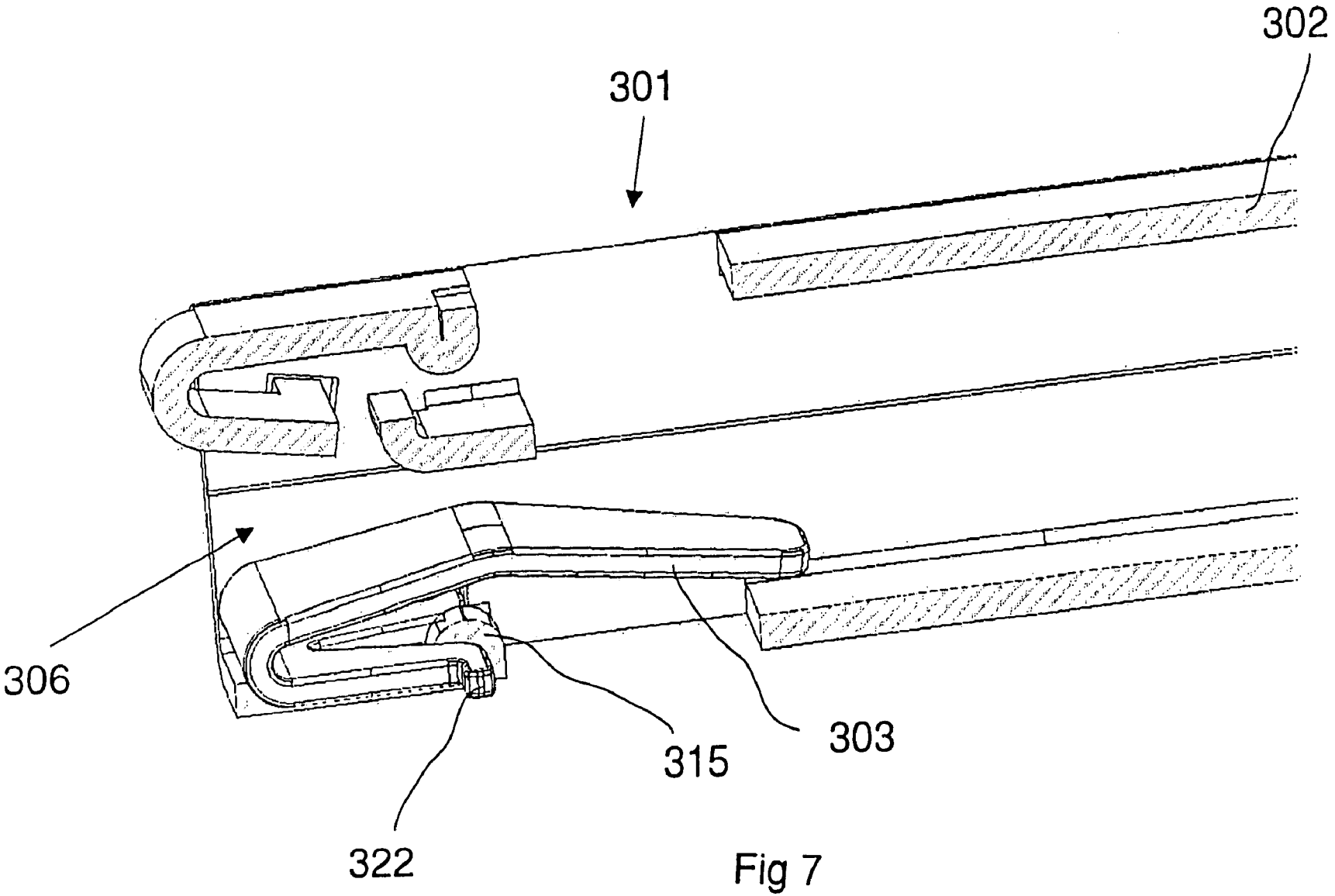
FIG. 7 is a representation corresponding to FIG. 3, however, with the elastic element, shown in FIGS. 5 and 6.

FIGS. 5 to 7 show a third embodiment of a female connector 301 with the base element 302, which has the receiving portion 305 and which corresponds to the first embodiment of the base element 2 of FIGS. 1 to 3. Also in this case, attachment through holes 313 are provided as in the embodiment of FIGS. 1 to 3. Furthermore, a securing tab 315 is provided. In connection with the base element 302, however, for forming the female connector 301 a changed elastic element 303 is used, as it is in FIG. 6 shown as an individual component and in FIG. 7 in a condition mounted in the accommodation chamber 306.

The elastic element 303 shown in FIG. 6 is made from a flat material of a non-corrosive spring steel, especially stainless steel, for example by means of punching and comprises two first leg portions 318, of which, respectively, engagement portions 322, bent at a right angle thereto, project for the engagement in the attachment through holes 313. Between the two a clearance is formed, into which, in the assembled condition, the securing tab 315 enters. The two first leg portions 318, arranged in one plane, are followed in a V-like, bent manner by a single second flat leg portion 319, to which again the third leg portion 320 is attached in a bent manner, wherein between the two a transition portion 321 is formed.

In the assembled condition of the elastic element 303 in the receiving portion 302, shown in FIG. 7, it is visible, that an assembly, similar to the embodiment of FIGS. 1 to 3, is carried out, i.e. the second leg portion 319 extends towards the contact portion. The third leg portion 320 extends away from the same. The description de-scribed in connection with FIG. 1 to 3 is also valid here.

Figure 8:
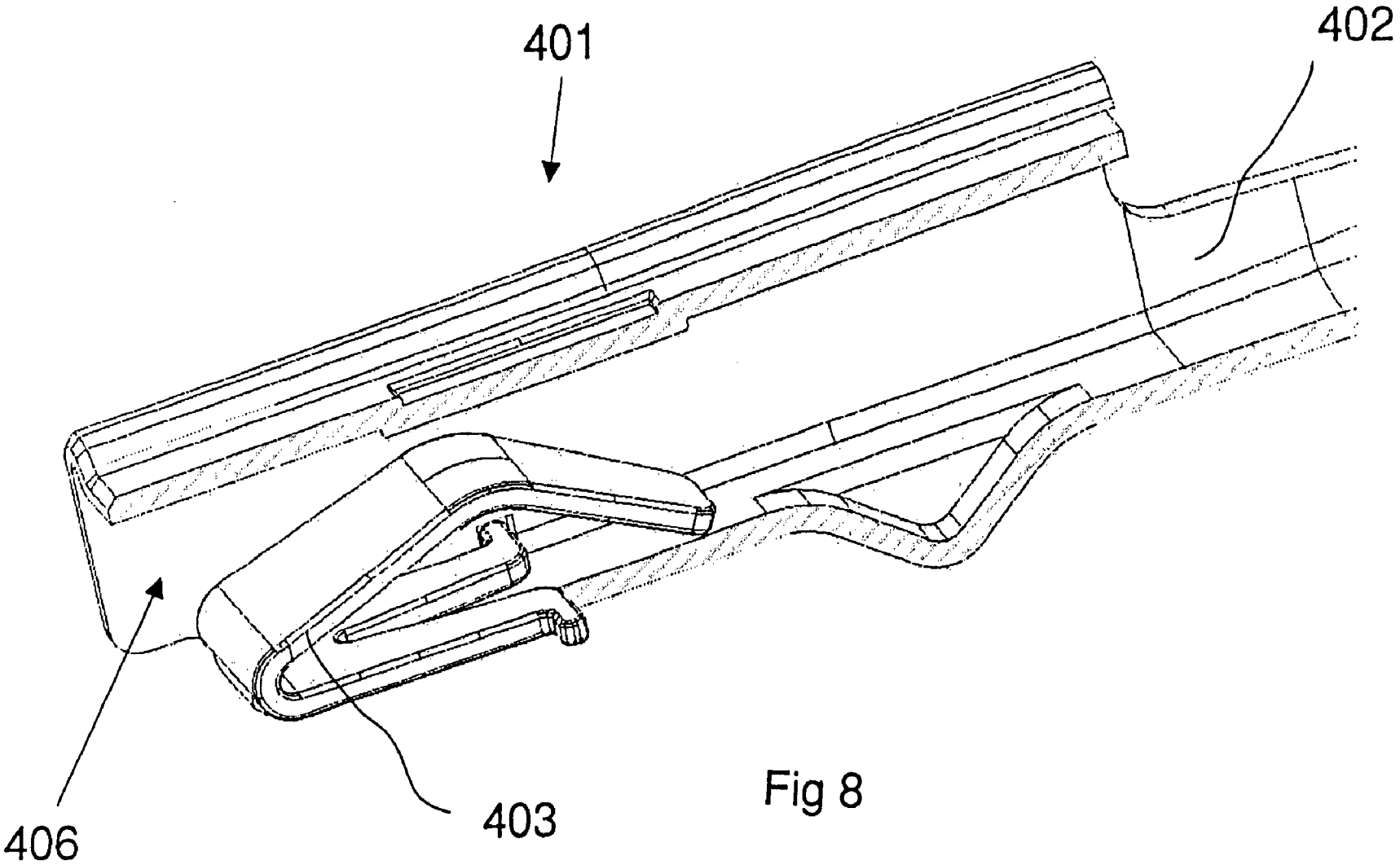
FIG. 8 is an embodiment of the female terminal, in which the base element corresponds to that of FIG. 4 and wherein the elastic element corresponds to that of FIGS. 5 to 7.

Finally, a fourth embodiment of a female terminal 401 is shown in FIG. 8, which comprises a base element 402, which corresponds to the base element 102 of FIG. 4. The female terminal further comprises an elastic element 403, which corresponds to the elastic element 303 of FIG. 5 to 7 and rests in the accommodation chamber 406.

What is claimed is:

1. Female terminal for the electrically conductive connection to a terminal pin, especially a flat-pin terminal, comprising a base element including (1) a tubular receiving portion which forms an enclosed accommodation chamber with an insertion opening for receiving the terminal pin and (2) a connection portion for fixedly retaining a conductor of a cable, said tubular portion having a contact portion for contacting the terminal pin, said base element being made of a material with a high electrical conductivity; and a separate elastic element provided in the accommodation chamber and formed from a non-corrosive spring steel, said elastic element including two first leg portions and at least one second leg portion extending from a first end of said two first leg portions such that the at least one second leg portions forms a V-shape with respect to said two first leg portions, said two first leg portions including engagement portions, at a second opposite end of said first leg portions, which extend away from each other for respectively engaging attachment through holes of the base element to retain said elastic element to said base element, said two first leg portions extending along a wall of the tubular receiving portion toward the insertion opening and, said at least one second leg portion extending into said accommodation chamber toward the contact portion to receive the terminal pin therebetween.

2. The female terminal according to claim 1, wherein the elastic element has, following the at least one second leg portion, at least one third leg portion, which is bent relative to the at least one second leg portion such that the at least one third leg portion extends away from the contact portion and that a transition portion of the elastic element between the at least one second leg portion and the at least one third leg portion forms the support base for the terminal pin.

3. The female terminal according to claim 1, wherein the base element has a receiving portion tubular in cross-section and that the accommodation chamber is enclosed by walls arranged at a right angle to each other.

4. The female terminal according to claim 3, wherein a wall is provided with a portion, projecting into the accommodation chamber and forming the contact portion.

5. The female terminal according to claim 3, wherein at least one contact tab, punched out from one wall and bent into the accommodation chamber, forms the contact portion.

6. The female terminal according to claim 1, wherein the elastic element is bent from a round wire and includes two second leg portions and two third leg portions, and wherein the third leg portions are connected to each other and the engagement portions are bent from the first leg portions, extending away from each other.

7. The female terminal according to claim 1, wherein the elastic element is bent from a flat material.

8. The female terminal according to claim 1, wherein the base element has a securing tab, which engages between the two first leg portions.

9. The female terminal according to claim 1, wherein the base element is formed by means of punching out and bending from a sheet material.

* * * * *